US010589913B2

(12) United States Patent
Chang

(10) Patent No.: US 10,589,913 B2
(45) Date of Patent: Mar. 17, 2020

(54) PLIERS HANGER

(71) Applicant: CHUN NIEN PLASTIC LTD., Taichung (TW)

(72) Inventor: Chi-Tsai Chang, Taichung (TW)

(73) Assignee: Chun Nien Plastic Ltd., Taichung (TW)

( * ) Notice: Subject to any disclaimer, the term of this patent is extended or adjusted under 35 U.S.C. 154(b) by 0 days.

(21) Appl. No.: 16/179,105

(22) Filed: Nov. 2, 2018

(65) Prior Publication Data

US 2019/0144186 A1 May 16, 2019

(30) Foreign Application Priority Data

Nov. 10, 2017 (TW) ..... 106216728 U

(51) Int. Cl.

| | |
|---|---|
| ***B65D 73/00*** | (2006.01) |
| ***B25H 3/00*** | (2006.01) |
| ***B65D 63/10*** | (2006.01) |
| ***B25B 7/00*** | (2006.01) |
| ***B65D 85/20*** | (2006.01) |

(52) U.S. Cl.

CPC ..... *B65D 73/0064* (2013.01); *B25H 3/006* (2013.01); *B65D 63/10* (2013.01); *B65D 63/1072* (2013.01); *B65D 73/0014* (2013.01); *B65D 85/20* (2013.01); *B25B 7/00* (2013.01)

(58) Field of Classification Search

CPC ..... B65D 73/0064; B65D 73/0014; B65D 63/10; B65D 63/1072; B65B 7/00; B25H 3/006

USPC .... 206/349, 361, 362, 362.4, 368, 370, 372, 206/378, 379

See application file for complete search history.

(56) References Cited

U.S. PATENT DOCUMENTS 6,241,208 B1 * 6/2001 Lin ..... B65D 73/0014 206/349

7,931,158 B1 * 4/2011 Wu ..... A47F 5/0006 211/70.6

* cited by examiner

*Primary Examiner* — Rafael A Ortiz

(74) *Attorney, Agent, or Firm* — Muncy, Geissler, Olds & Lowe, P.C.

(57) ABSTRACT

A pliers hanger is provided, configured to restrict a pliers. The pliers includes two handling bodies pivotally connected with each other. Each of the two handling bodies has a holding portion and a clamping portion at opposite ends thereof. The pliers hanger includes a main body, a sleeve portion and a restricting assembly. The main body includes a hanging portion. The sleeve portion is disposed on the main body. The restricting assembly includes a cable tie and a through hole. One of the cable tie and the through hole is disposed on the main body, and the other is disposed on the sleeve portion. The cable tie has a first engaging portion, and the cable tie is configured to be wound around the pliers and between the holding portions of the two handling bodies and restrictedly engaged in the through hole.

7 Claims, 6 Drawing Sheets

PLIERS HANGER

BACKGROUND OF THE INVENTION

Field of the Invention

The present invention relates to a pliers hanger.

Description of the Prior Art

A pliers is indispensable for engineering work or home repair so that every hardware store displays pliers for customers to pick up and buy. Pairs of pliers are displayed in stores are packed with blisters for easy hanging and anti-thefting. However, the conventional hangers only allow customers to watch the pliers but customers cannot hold handles of the pair of pliers to try it out so that it is difficult for customers to pick up a suitable product to buy.

The present invention is, therefore, arisen to obviate or at least mitigate the above-mentioned disadvantages.

SUMMARY OF THE INVENTION

The main object of the present invention is to provide a pliers hanger configured to restrict a pliers for hanging and anti-thefting, and the plier hanger allows customer to hold a holding portion of pliers and try it out.

To achieve the above and other objects, the present invention provides a pliers hanger which is configured to restrict a pliers. The pliers includes two handling bodies. Each of the two handling bodies has a holding portion and a clamping portion at opposite ends thereof. The pliers hanger includes a main body, a sleeve portion and a restricting assembly. The main body includes a hanging portion. The sleeve portion is disposed on the main body and configured for the clamping portions of the two handling bodies to be inserted therewithin. The restricting assembly includes a cable tie and a through hole. One of the cable tie and the through hole is disposed on the main body, and the other of the cable tie and the through hole is disposed on the sleeve portion. The cable tie has a first engaging portion, and the cable tie is configured to be wound around the pliers and between the holding portions of the two handling bodies and restrictedly engaged in the through hole.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
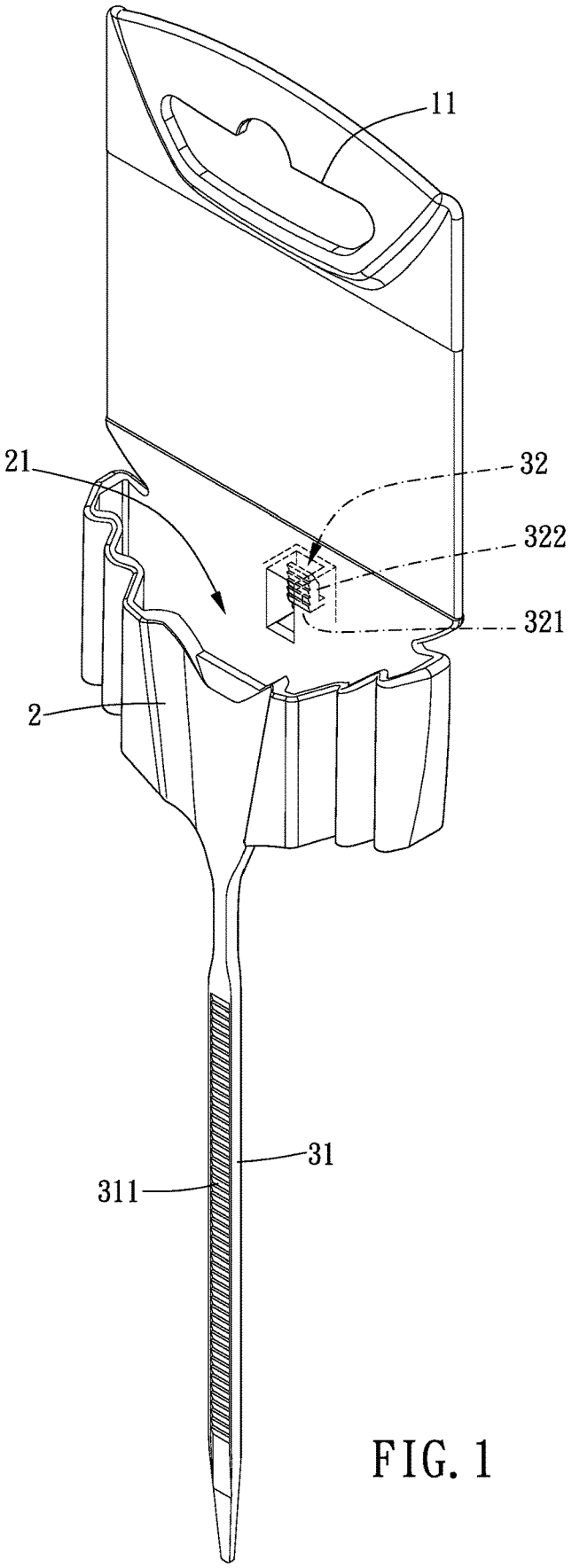
FIGS. 1 and 2 are stereograms of a preferable embodiment of the present invention.
Figure 2:
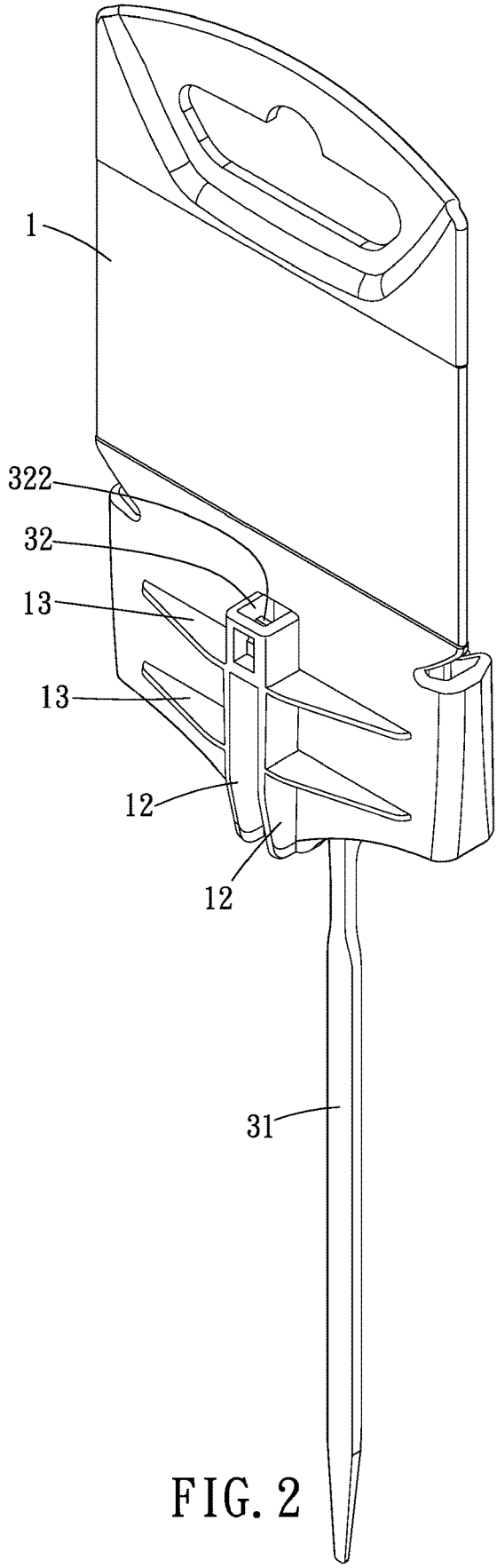
Figure 3:
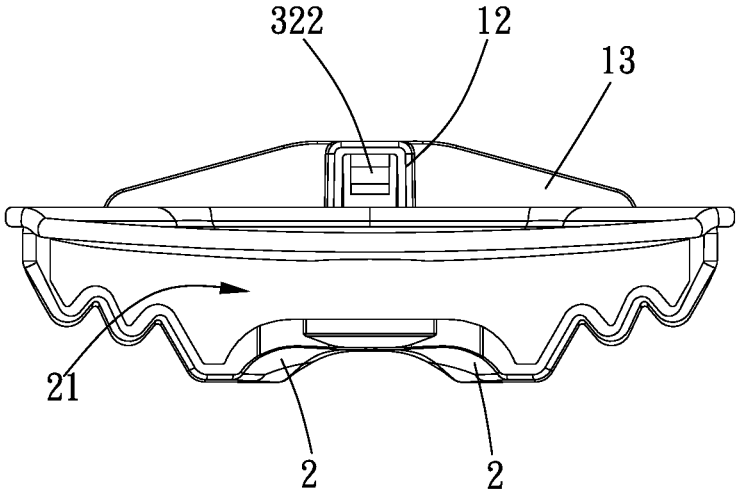
FIG. 3 is a top view of a preferable embodiment of the present invention.
Figure 4:
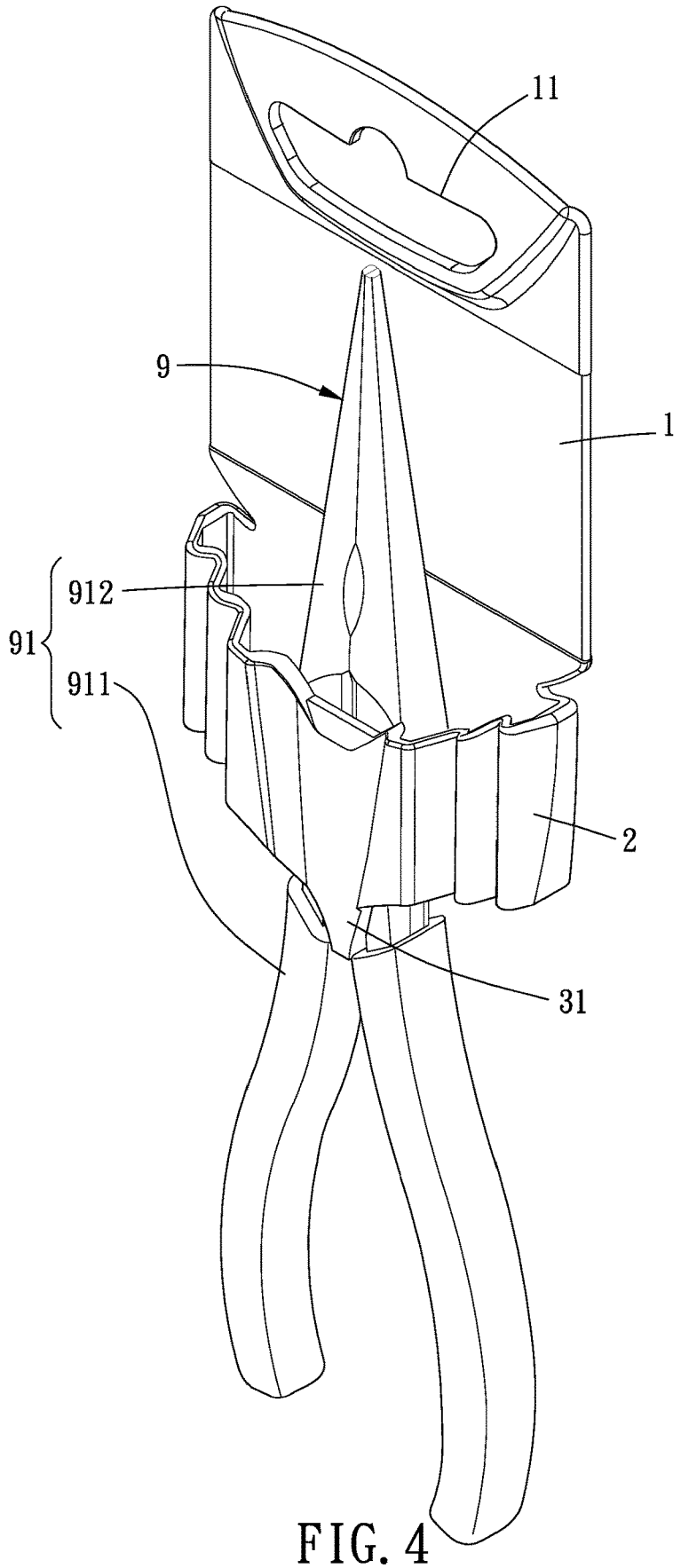
FIGS. 4 and 5 are assembling schematics of a preferable embodiment of the present invention.
Figure 5:
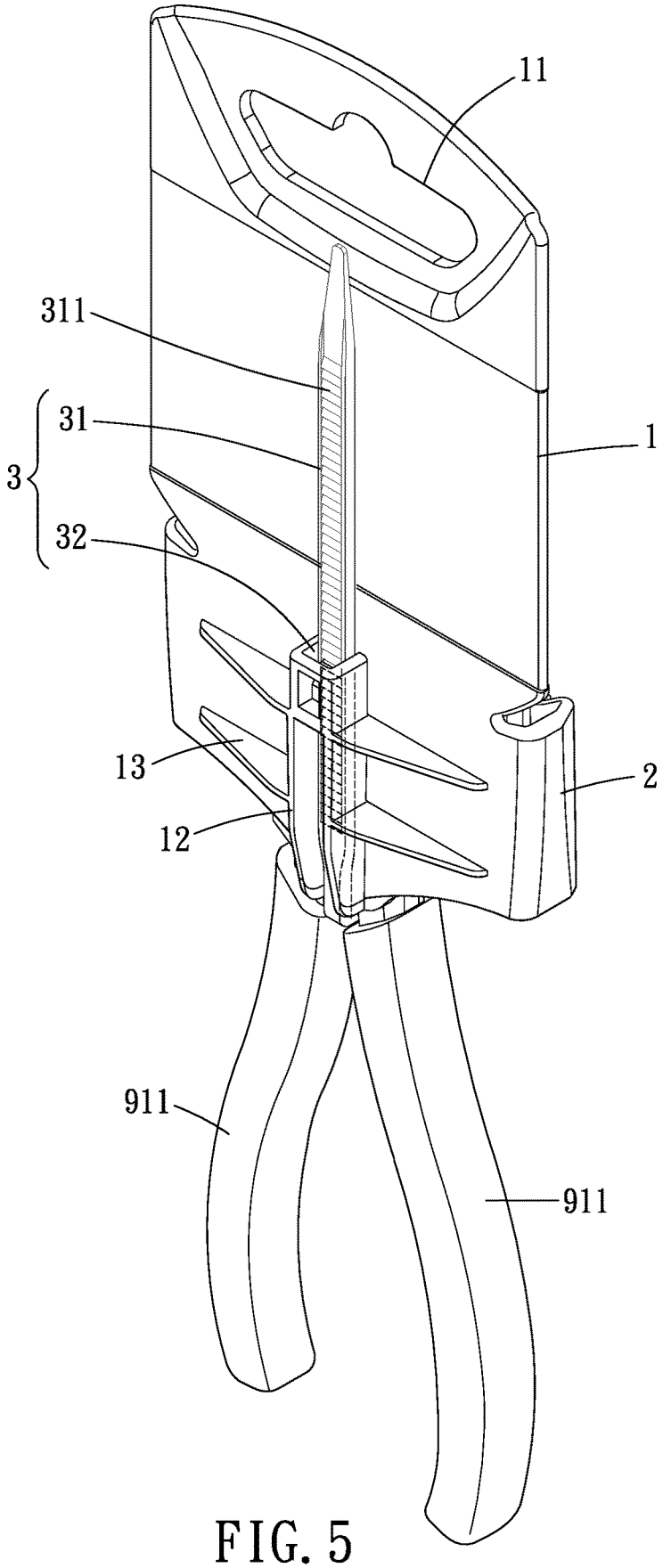

Please refer to FIGS. 1 to 7 for a preferable embodiment of the present invention. A pliers hanger of the present invention is configured to restrict a pliers 9. The pliers 9 includes two handling bodies 91 pivotally connected with each other, and each of the two handling bodies 91 has a holding portion 911 and a clamping portion 912 at opposite ends thereof. The pliers hanger includes a main body 1, a sleeve portion 2 and a restricting assembly 3.

The main body 1 includes a hanging portion 11. In this embodiment, the hanging portion 11 is a hanging hole. The hanging portion may be a hook in another embodiment.

The sleeve portion 2 is disposed on the main body 1 and configured for the clamping portions 912 of the two handling bodies 91 to be inserted therewithin.

The restricting assembly 3 includes a cable tie 31 and a through hole 32. One of the cable tie 31 and the through hole 32 is disposed on the main body 1, and the other of the cable tie 31 and the through hole 32 is disposed on the sleeve portion 2. The cable tie 31 has a first engaging portion 311, and the cable tie 31 is configured to be wound around the pliers 9 and between the holding portions 911 of the two handling bodies 91 and restrictedly engaged in the through hole 32. Therefore, the pliers 9 is restricted within the sleeve portion 2 by the cable tie 31, and the pliers hanger is configured to restrict the pliers 9 for hanging and anti-thefting. The pliers hanger allows customer to hold the holding portions 911 of the pliers 9 and try it out. Furthermore, the pliers 9 is detachable after the cable tie 31 is cut off.

The sleeve portion 2 is integrally connected with the main body 1. The sleeve portion 2 and the main body 1 define a sleeving hole 21, and an opening direction of the sleeving hole 21 faces toward the hanging portion 11. Respective thicknesses of the two handling bodies 91 are larger than a maximum distance between the sleeve portion 2 and the main body 1, which prevents the two handling bodies 91 form directly passing through the sleeve portion 2.

Specifically, the cable tie 31 is integrally connected to the sleeve portion 2 away from hanging portion 11, and the through hole 32 is disposed on a side of the main body 1 opposite to the sleeve portion 2.

In this embodiment, the side of the main body 1 opposite to the sleeve portion 2 has two first partitions 12 protruding thereon, and the through hole 32 is disposed between the two first partitions 12. Extending directions of the two first partitions 12 are parallel to the cable tie 31, and the cable tie 31 is passed between the two first partitions 12 and penetrated through the through hole 32.

Preferably, the main body 1 further has two second partitions 13 protruding thereon, and the two second partitions 13 are transversely connected with the two first partitions 12 so as to increase structural strength of the two first partitions 12 and prevent the two first partitions 12 from being broken.

In this embodiment, two ends of the sleeve portion 2 are integrally connected with the main body 1 so as to increase structural strength and reduce manufacturing cost. The sleeving hole 21 is tapered toward opposite sides of the cable tie 31 and in a direction away from the main body 1 as viewed from the opening direction of the sleeving hole 21. The sleeve portion 2 is wavy so as to receive different one of pliers with various sizes and avoid the pliers moving in a direction transverse to the cable tie 31.

Figures 6, 7:
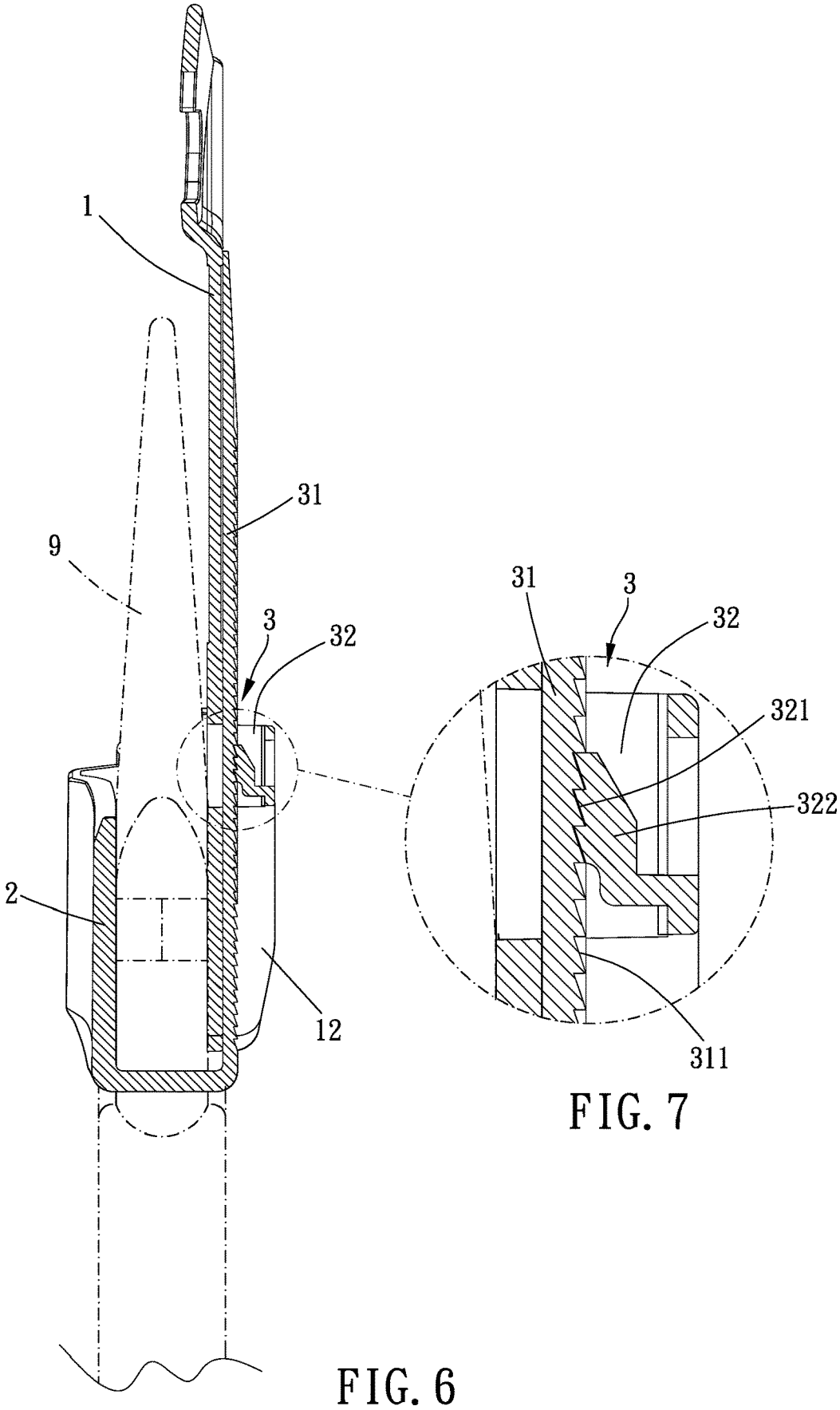
FIG. 6 is a cross-sectional view of a preferable embodiment of the present invention.
FIG. 7 is a partial enlargement of FIG. 6.

A hole wall of the through hole 32 has a second engaging portion 321 which is ratchetedly and restrictedly engagable with the first engaging portion 311 (as shown in FIG. 7) so as to prevent the cable tie 31 from departing from the through hole 32. Furthermore, the hole wall of the through hole 32 has an extending segment 322 integrally extending therefrom, and the second engaging portion 321 is disposed on the extending segment 322. When the cable tie 31 is penetrated to the through hole 32, the extending segment 322 is slightly swingable so that the first engaging portion 311 and the second engaging portion 321 are slippable and the cable tie 31 can be smoothly penetrated through the through hole 32.

In summary, the pliers is restricted within the sleeve portion by the cable tie, and the pliers hanger is configured to restrict the pliers for hanging and anti-thefting. The pliers hanger allows customer to hold the holding portion of the pliers and try it out.

Moreover, the main body, the sleeve portion and the restricting assembly are integrally made in one piece so that the pliers hanger has simple structure and low cost. The pliers hanger is easy to assemble or disassemble with the pliers.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A pliers hanger, configured to restrict a pliers, the pliers including two handling bodies pivotally connected with each other, each of the two handling bodies having a holding portion and a clamping portion at opposite ends thereof, the pliers hanger including:

a main body, including a hanging portion;

a sleeve portion, disposed on the main body, configured for the clamping portions of the two handling bodies to be inserted therewithin; and a restricting assembly, including a cable tie and a through hole, one of the cable tie and the through hole being disposed on the main body, the other of the cable tie and the through hole being disposed on the sleeve portion, the cable tie having a first engaging portion, the cable tie configured to be wound around the pliers and between the holding portions of the two handling bodies and restrictedly engaged in the through hole, wherein the sleeve portion is integrally connected with the main body, the sleeve portion and the main body define a sleeving hole, an opening direction of the sleeving hole faces toward the hanging portion, and respective thicknesses of the two handling bodies are larger than a maximum distance between the sleeve portion and the main body, wherein the cable tie is integrally connected to the sleeve portion away from the hanging portion, and the through hole is disposed on a side of the main body opposite to the sleeve portion, and wherein the side of the main body opposite to the sleeve portion has two first partitions protruding thereon, the through hole is disposed between the two first partitions, and extending directions of the two first partitions are parallel to the cable tie.

2. The pliers hanger of claim 1, wherein the main body further has two second partitions protruding thereon, and the two second partitions are transversely connected with the two first partitions.

3. The pliers hanger of claim 1, wherein a hole wall of the through hole has a second engaging portion which is ratchetedly and restrictedly engagable with the first engaging portion.

4. The pliers hanger of claim 3, wherein the hole wall of the through hole further has an extending segment integrally extending therefrom, and the second engaging portion is disposed on the extending segment.

5. The pliers hanger of claim 1, wherein the main body further has two second partitions protruding thereon, the two second partitions are transversely connected with the two first partitions; two ends of the sleeve portion are integrally connected with the main body, and the sleeve portion is wavy; the sleeving hole is tapered toward opposite sides of the cable tie and in a direction away from the main body as viewed from the opening direction of the sleeving hole; a hole wall of the through hole has a second engaging portion which is ratchetedly and restrictedly engagable with the first engaging portion; the hole wall of the through hole further has an extending segment integrally extending thereon, and the second engaging portion is disposed on the extending segment.

6. A pliers hanger, configured to restrict a pliers, the pliers including two handling bodies pivotally connected with each other, each of the two handling bodies having a holding portion and a clamping portion at opposite ends thereof, the pliers hanger including:

a main body, including a hanging portion;

a sleeve portion, disposed on the main body, configured for the clamping portions of the two handling bodies to be inserted therewithin;

a restricting assembly, including a cable tie and a through hole, one of the cable tie and the through hole being disposed on the main body, the other of the cable tie and the through hole being disposed on the sleeve portion, the cable tie having a first engaging portion, the cable tie configured to be wound around the pliers and between the holding portions of the two handling bodies and restrictedly engaged in the through hole, wherein the sleeve portion is integrally connected with the main body, the sleeve portion and the main body define a sleeving hole, an opening direction of the sleeving hole faces toward the hanging portion, and respective thicknesses of the two handling bodies are larger than a maximum distance between the sleeve portion and the main body, and wherein two ends of the sleeve portion are integrally connected with the main body, and the sleeve portion is wavy.

7. The pliers hanger of claim 6, wherein the sleeving hole is tapered toward opposite sides of the cable tie and in a direction away from the main body as viewed from the opening direction of the sleeving hole.

* * * * *